United States Patent [19]

Borst

[11] Patent Number: 4,869,342

[45] Date of Patent: Sep. 26, 1989

[54] DRIVE IN MANHOLE STEP

[75] Inventor: Ronald W. Borst, Kansas City, Mo.

[73] Assignee: Clay & Bailey Mfg. Co., Inc., Kansas City, Mo.

[21] Appl. No.: 264,846

[22] Filed: Oct. 31, 1988

[51] Int. Cl.[4] ..... E06C 9/04

[52] U.S. Cl. ..... 182/90; 182/46

[58] Field of Search ..... 182/90, 92, 46, 87

[56] References Cited

U.S. PATENT DOCUMENTS

| | | | |
|---|---|---|---|
| 4,100,997 | 7/1978 | Peacock | 182/90 |
| 4,241,543 | 12/1980 | Foscarini | 182/90 |
| 4,610,330 | 9/1986 | Borst | 182/90 |
| 4,655,318 | 4/1987 | Bowen | 182/90 |
| 4,660,681 | 4/1987 | Fenhausern | 182/90 |
| 4,702,349 | 10/1987 | Fenhausern | 182/46 |
| 4,771,861 | 9/1988 | Fenhausern | 182/90 |
| 4,778,032 | 10/1988 | Takahashi | 182/90 |

*Primary Examiner*—Reinaldo P. Machado
*Attorney, Agent, or Firm*—Thomas M. Scofield

[57] ABSTRACT

Improvements in plastic coated, steel core reinforced manhole steps; particular improvements in the drive-in or hammer-in ends of a U-configuration manhole step construction, which improvements involve the provision of uniform outer diameter retainer elements on a uniform outer diameter stem for use in either tapered or cylindrical manhole wall holes or openings; combinations of barb-like retainer elements and cylinder-like retainer elements on the drive-in ends of uniform diameter manhole leg ends adaptable for driving into and securing manhole step legs in either tapered or cylindrical manhole wall holes or openings.

14 Claims, 2 Drawing Sheets

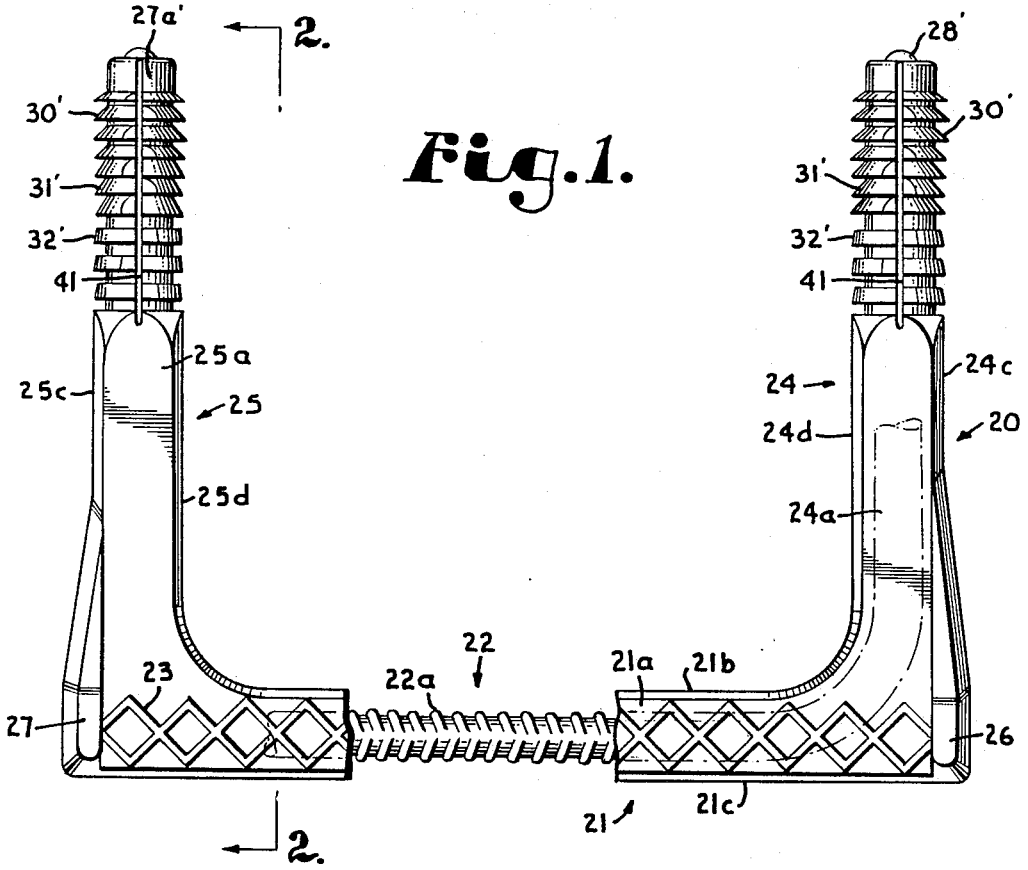
Fig. 1.
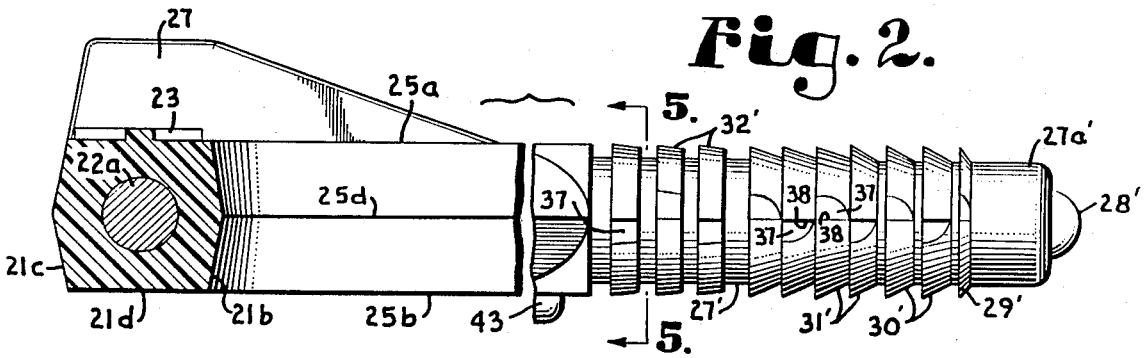
Fig. 2.
Fig. 3.
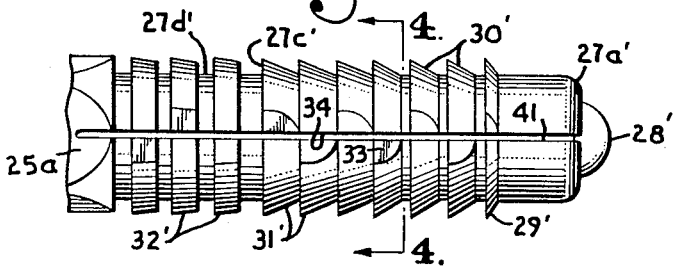
Fig. 4.
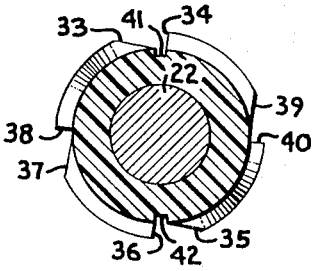

Fig. 5.
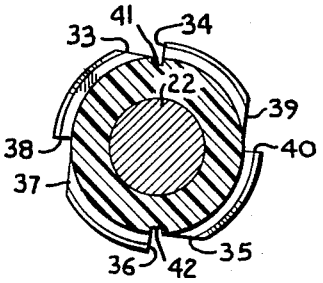
Fig. 6.
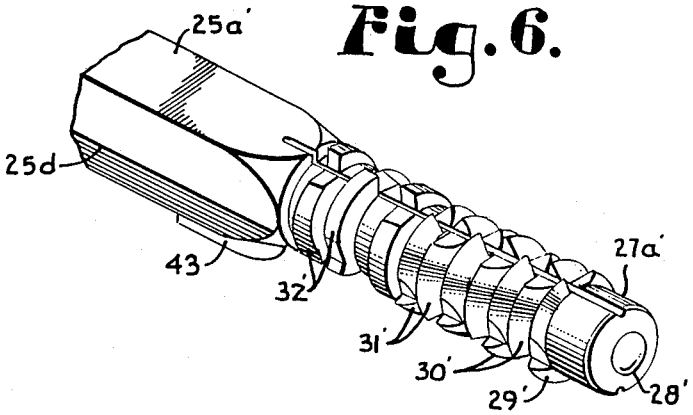
Fig. 7.
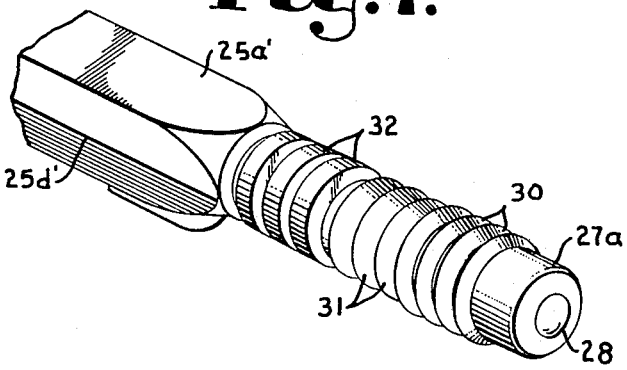
Fig. 10.
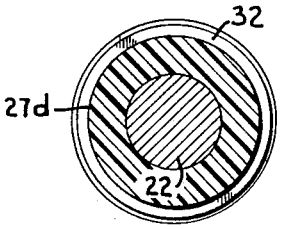
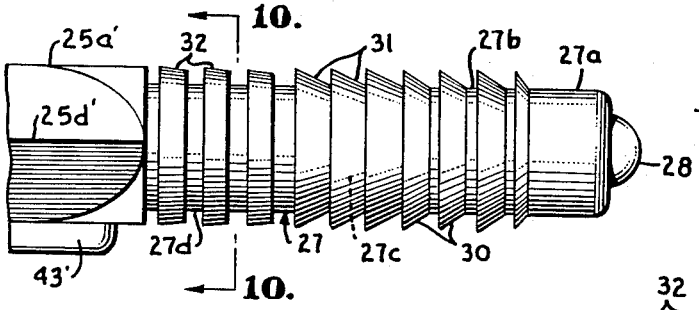
Fig. 8.
Fig. 9.
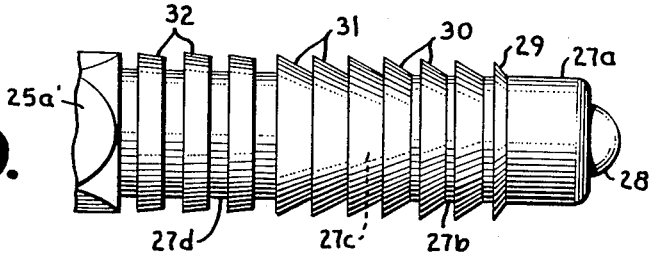

DRIVE IN MANHOLE STEP

BACKGROUND OF THE INVENTION

This invention relates and is directed to a step useable in connection with construction walls of the type particularly encountered in manhole walls, masonry walls, retaining walls, and the like. These steps are typically received in holes formed in cast concrete or embedded in cast concrete or other like type walls, particularly in manholes.

In the constructions and applications for which this type of step is employed, the conditions to which the steps are exposed, unless the steps are of particular types and materials of construction, tend to cause them to deteriorate rapidly, with danger and hazards to the users of such steps and, further, requirements of replacement effort and expense. The steps are typically exposed directly to moisture and continued dampness for long periods of time, literally constantly and, further, to whatever chemicals may be present in the water, sewage and deleterious fumes emanating therefrom. Rapid corrosion, pitting and deteriorating of conventional metal steps from such various causes are well known. It is thus a principle object in a plastic step (plastic coated, steel reinforced step) to remain intact, impervious to the environment, strong and working for long periods of time under extremely adverse conditions.

Due to constant exposure of the outer surface of the step to dampness and moisture, as well as various adverse other materials, the steps may become slippery and/or coated, thereby providing a most precarious foothold for workmen. The provision of steps affording a sure foothold is necessary as two hundred plus pound men carrying heavy loads up and down the steps (of perhaps near equal weight) are not unusual.

Because plastic steps, even with the strong and durable plastics presently known to the art, per se, without a reinforcing metal bar therewithin, have not proved reliable, or strong enough in actual commercial use, plastic coated, steel core reinforced steps are one commercial product which is currently produced for use. The plastic provides a protective coating or shell against chemical action on the basic steel core frame and thus solves the problems of continuous presence of moisture and water, whether or not corrosive chemicals are present therein. The plastic also provides protection against electrical or electro-chemical action perhaps present in the environment if bare metal were present.

The particular improvement of the subject invention is directed to a new configuration of the drive-in or hammer-in ends of a plastic coated, steel reinforced manhole step. This particularly involves the outer configuration of the cast plastic sheath or coating on the outer three to four inches (typically) of the reinforcement bar of the manhole step type in question. Such new end piece configurations are improvements over (in both the herein disclosed forms thereof) the outer leg end configuration of the plastic step disclosed in the Peacock patent 4,100,997 and further over the same in the disclosure of Borst, Ser. No. 6,34,373, filed July 25, 1984 for "Drive-In Manhole Step Construction", now U.S. Pat. No. 4,610,330 issued Sept. 9, 1986.

OBJECTS OF THE INVENTION

A first object of the invention is to substantially improve over the drive-in or hammer-in leg end plastic coating configuration employed in the commercial steel core reinforced manhole steps of M.A. Industries, Inc. of Peachtree City, Georgia, such improvement particularly also including the shape disclosure of a particular leg end configuration in U.S. Pat. Peacock 4,100,997.

A second object of the invention is to substantially improve over the drive-in or hammer-in leg end plastic coating configuration disclosed in the U.S. pat. application to Ronald W. Borst "Drive-In Manhole Step Construction", U.S. Ser. No. 6,34,373, filed July 25, 1984, now U.S. Pat. No. 4,610,330 issued Sept. 9, 1986.

Another object of the invention is to provide improved drive-in or hammer-in leg ends of a U-configuration manhole step construction wherein barb-like elements and cylinder-like elements are employed, in combination, to enable the effective attachment of a uniform outer diameter leg end construction within either a tapered hole in a manhole wall or a cylindrical hole therein.

Another object of the invention is to provide such improved manhole step ends for driving into tapered and cylindrical manhole step passages or holes wherein means are provided to vent water and air and any other materials that may be in the leg end receiving holes during the drive-in process, while yet not interfering with the attachment strength of the manhole step leg ends in the manhole.

Other and further objects of the invention will appear in the course of the following description thereof.

DESCRIPTION OF THE DRAWINGS

In the drawings, which form a part of the instant specification and are to be read in conjunction therewith, embodiments of the invention are shown and, in the various views, like numerals are employed to indicate like parts.

FIG. 1 is a vertical plan view from above of an entire manhole step incorporating the subject manhole step engagement and improvement, this figure cut away centrally of the bottom portion thereof to show the reinforcement bar within the plastic coating or sheathing.

FIG. 2 is a view taken along the line 2—2 of FIG. 1 in the direction of the arrows with the view enlarged and somewhat length condensed in the showing.

FIG. 3 is an enlarged fragmentary view of the upper left hand corner of FIG. 1 showing the details of the drive-in end of the manhole step leg.

FIG. 4 is a view taken along the line 4—4 of FIG. 3 in the direction of the arrows.

FIG. 5 is a view taken along the line 5—5 of FIG. 2 in the direction of the arrows.

FIG. 6 is a three-quarter perspective view from above of the leg end of the upper left hand corner of FIG. 1.

FIG. 7 is a three-quarter perspective view from above taken of a modified form of the subject invention showing a leg end analogous to that seen in FIG. 6.

FIG. 8 is a side view of the leg end of FIG. 7.

FIG. 9 is a top view of the leg end of FIG. 7.

FIG. 10 is a view taken along the line 10—10 of FIG. 8 in the direction of the arrows.

FIGS. 1-6, INCLUSIVE

Referring first to the improvements seen in FIGS. 1-6, inclusive, the manhole step in question is generally designated 20. It has an outboard (with respect to the manhole or other wall supporting the step in use) step portion generally designated 21, such step portion having a top wall 21*a*, an inboard (with respect to a step receiving wall) wall 21*b*, an outboard wall 21*c* and a bottom wall 21*d*. Received within the plastic outer sheath or coating generally designated 21 is the base 22*a* of a U-shaped, deformed reinforcement bar generally designated 22 and having inwardly or inboardly extending, toward the manhole wall, free ended legs formed integrally therewith (FIGS. 4 and 5). Legs 24 and 25 extend outwardly from step portion 21. On the top surface 21*a* of the step plastic coating, there is formed a raised, continuous repeating diamond shape friction member 23 which preferably extends the length of the step element 21 on the top surface thereof.

Looking at FIG. 1, the right hand formed plastic leg element 24 is opposed by the left hand formed plastic leg element 25, both of these leg elements receiving extensions of the reinforcement bar therewithin up to essentially the outermost ends thereof. These leg elements, in the outboard portions thereof, have flat upper surfaces 24*a*, 25*a*, flat lower surfaces 24*b* (not seen), 25*b*, outer sides 24*c*, 25*c* and inner sides 24*d*, 25*d*. The sides 21*c*, 21*b*, 24*c*, 24*d*, 25*c* and 25*d* are preferably not flat, for mold separation purposes, each such being outwardly angled to a center line along each base thereof. Polypropylene is a suitable plastic.

Suitable end safety flanges 26 and 27 are provided connected to the ends of the molded foot receiving step portions 21, such also extending along the sides of each of the legs 24 and 25 at the outer faces thereof. Stops 43 (only one seen in FIG. 2) are provided on the free end lower walls 24*b* and 25*b*, such terminating inwardly just short of the end engagement pieces to be discussed.

What has essentially been heretofore described is the well known prior art construction or structure of a manhole step construction comprising a U-shape, strong metal reinforcing bar having molded thereover an integral, plastic configured step, the latter fully enclosing said reinforcement bar to make a composite, yet integral, plastic coated, steel core reinforced manhole step body. This body has elongate, basically straight step portion 21 at the base thereof (U base) with two substantially like and symmetrical leg support members 24 and 25 extending at substantial right angles from the ends of step portion 21 in the same direction and at least substantially parallel to one another.

Passing to portions of the device not yet described, the free outer ends of the leg support members 24 and 25 are adapted to be driven or hammered into paired, spaced apart, cylindrical or inwardly tapered, formed holes in a manhole or like wall. Such wall may be concrete, reinforced concrete or other suitable material.

FIGS. 7–10, INCLUSIVE

Turning to FIGS. 7–10, inclusive, this construction will be first described because it is simpler than the construction of FIGS. 1–6, inclusive. What is shown in or focused on in FIGS. 7–10, inclusive is the drive-in or hammer-in end of one of the legs 24, 25. Because of the difference in the structure of the leg end elements, the outboard elements of the leg are numbered the same, but primed as with respect to the outboard elements of the legs already described with respect to FIGS. 1–6, inclusive. In these views, then, inboard of the leg portion 25, what is provided is an elongate, uniform diameter, cylindrical leg extension generally designated 27. Leg end 27 has the following portions thereof.

In the first place, the inboardmost cylindrical portion 27*a* preferably has provided thereon a hemispherical knob or tip 28 which, if the formed hole in the manhole wall is short (or blocked at the end by material) tends to bottom out first and flatten out to enable further insertion of the leg support member in question. On the outboard end of tip or end piece 27*a*, at 29, there is provided an uninterrupted circumferential barb or flange ring.

There is then provided a length 27*b* of cylindrical end portion 27 on which are mounted or provided a plurality, here three, of barb rings of continuous character (or flange rings) as at 30. Again moving outboard, there is further provided another length of leg end 27*c* upon which are provided a plurality (here three) of more massive barb rings 31 or flange rings 31 also of continuous circumferential unbroken character.

There is then provided cylindrical leg end portions 27*d* upon which are mounted or provided a plurality of semi-cylindrical engaging rings 32. The outer faces of rings 32 may be slightly beveled inwardly as may be seen in the drawings.

What has thus been provided in the described structure are at least three levels of difficulty of deflection, here actually four. Thus, the slight, least massive barb ring 29 is relatively easily deflected as the leg end is driven into either a cylindrical or tapered hole in a manhole wall. The three next barb rings 30 are less easily deflected than ring 29. The massive, material filled barb rings 31 are yet harder to deflect than the barb rings 30. Finally, there are provided the semi-cylindrical rings 32 which are the most difficult to deflect of all these rings.

Accordingly, as the end 27*a* is inserted into and then driven into a tapered or cylindrical hole, the barb rings, 29, 30 and 31 and cylindrical rings 32 resist deflection to the degrees indicated, permitting the leg ends to be driven into the holes to the desired depth, but only by distorting and deflecting the said barb rings and cylindrical rings as the leg end is driven in. The deflected engagement of the various ring members described, by the inner surface of the wall openings or holes, operates to retain the leg ends in the openings or holes, whether the openings are inwardly tapered or cylindrical.

Thus it has been provided that a nontapered leg portion 27 end with nontapered engaging elements thereon will and may satisfactorily engage either a tapered hole or a cylindrical hole in effective, engaging, step retaining fashion. By providing the more easily deflected elements at the leg inboard ends (first into the hole), a chain of rings of increasingly difficult deflection is available to operate in the most effective manner by the time the full leg end is hammered into the wall opening, passage or hole.

FIGS. 1–6, INCLUSIVE LEG ENDS

Referring back to FIGS. 1–6, inclusive, the leg ends shown therein are the same as that just described for FIGS. 7–10, inclusive, with the exception that means are provided for relieving pressure in the manhole wall hole or passage as the step end is driven thereinto. Since the step ends are the same between FIGS. 7–10, inclusive and 1–6, inclusive except for the pressure relief means provided, the barb rings and near cylindrical rings will be numbered the same, but primed, as well as the portions of the leg end lengths. Thus there are three different sizes (all being of the same greatest outer diameter) of barb rings 29', 30', 31' and a set of near cylindrical rings 32' (also of the same greatest outer diameter).

The difference between the interrupted barb rings 29', 30' and 31', as well as the interrupted cylindrical rings 32' from the continuous such rings seen in FIGS. 7–10, inclusive is that at the top, bottom and sides thereof (90° displaced each from the other), all the rings are relieved or beveled. This is best seen in FIGS. 4 and 5 where the top relief 33 has facing wall 34, the bottom relief 35 has facing wall 36, the inside relief 37 has facing wall 38, and outside relief 39 has facing wall 40. As may be seen in the views, the bevels of adjacent single sets of barb rings and cylindrical rings preferably run opposite to one another. The provision of these beveled reliefs of the ring bodies operates to change the continuous barbs and continuous cylinders into barb segments and cylinder segments of approximately 90° arc. There is also provided, centrally of the top and bottom of the leg ends, an elongate groove or slot 41 (top) and 42 (bottom). Slots 41 and 42 extend the entire length of the leg ends, thus into and from tip **27*a*' back through the cylindrical rings 32' and, optionally, somewhat into the shoulder portion 25*a* as may be seen in FIG. 3. With respect to the bottom groove or channel, such extends into the lower wall 25*b* short of stop 28**, preferably.

As a specific example of a leg end with typical dimensions, not intended to be limiting, the boss 28' is 3/16ths of an inch in height. The outer diameter of the entire leg portion 27' is 0.890 inches. The outer diameter of the barb or flange rings 29', 30' 31', as well as that of cylinder rings 32' is 1.100 inches. The length of small ring 29' is typically 1/16th of an inch. The length of the bar rings 30' is 3/16ths of an inch. The length of the cylinder rings 32' is also 3/16ths of an inch. The length of the barb rings 31' is 4/16ths of an inch.

The angle of ring 29 with respect to the cylinder 27' surface is roughly 59°. The angle of the barb rings' inboard sloping faces to the surface 27' is about 29°. The angle of the thicker barb rings 31' to the surface 27' is about 23°. The length of the leg end 27' from the base of boss 28' to the beginning of wall portion 25' is approximately 3 3/16ths inches. The greatest lengths of slots 41 and 42 is 3⅜ths inches. The slot widths are 1/16 inch. The reinforcement bar end is ⅛ of an inch from the base of boss 28'.

OPERATION FIGS. 7–10, INCLUSIVE

As has been described, the outer diameters of leg end zones **27*a*, 27*b*, 27*c* and 27*d* are all identical. Also, as previously described, the reinforcement bar 22 comes up to within a quarter to one eighth of an inch of the outer end of member 27*a* or that distance short of the base of member 28. Stops 43'(like 28**) prevent the driving or hammering in of the ends of the manhole step legs therepast. Tapered holes may be formed in conventional manhole walls or any ladder rung bearing walls in various manners. Once such way is seen in the Craig B. Williams U.S. Pat. No. 4,365,780, issued Dec. 28, 1982, for "Removable Insert For Forming Holes In Concrete And The Like". Cylindrical holes are generally provided by drilling, not by casting, because nontapered casting members are often difficult to retrieve from the openings they form.

With a tapered hole, it is necessary that the end member **27*a* either be of small enough diameter or yieldable enough (around the rebar therewithin) that it can be seated or inserted (driven in or hammered in) a sufficient distance that the entire leg end length 27*a*–27*d*, inclusive be received within the wall opening or hole. It is also necessary that the barb rings 29, 30 and 31 and near cylindrical rings 32** all be engaged by the inner wall surface of the opening, passage or hole into which the leg ends are driven.

Typically, some or all of the bar and cylinder rings 30', 31' and 32' are engaged in the tapered hole before the leading edge of end **27*a*' engages the hole inner surface. The end 27*a*' may go in half the depth of the tapered hold before the barbs and cylinders engage. A line drawn from the leading edge of 27*a* to the leading edge of leg portions 24 and 25** shows how the engagement is made.

Since the barb rings 29 and 30 are to be driven into the least internal diameter portion of the hole or passageway, they must be more readily deflectable than the outer barb rings 31 and outermost cylindrical rings 32. Thus, barb rings 29, 30 are the most easily deflected, the heavier, more massive barb rings 31 are considerably less easily deflected and the rigid or semi-rigid cylindrical rings 32 are the least easily deflected by engagement with the inner wall of a tapered or cylindrical hole. Nevertheless, it must be emphasized that the outer diameter of the near cylindrical rings 32 is greater than the inner diameter of the outermost portion of the tapered hole into which the leg end is driven in order that all of the rings, barbed and near cylindrical, are in fact strongly and workingly engaged in the tapered hole. Thus rings 32' do deflect somewhat, as well as compress.

FIGS. 1–6, INCLUSIVE OPERATION

It has been previously described how each of the barb rings, 29', 30', 31' and cylindrical rings 32' of the construction of FIGS. 1–6, inclusive are relieved or beveled off at four radial positions thereof, specifically, at the top and bottom and sides, such beveled reliefs 90° displaced from one another around the periphery of the rings. Further, the existence of grooves 41 and 42 has been described.

The actions of the barb rings 29', 30' and 31', as well as the action of the near cylindrical rings 32' are essentially the same in engagement with the inner wall of a tapered or cylindrical hole. In a cylindrical hole, the outer diameter of portions **27*a*' and 27' (or 27*b*', 27*c*' and 27*d*'**) must be somewhat less than the greatest inner diameter of the hole. However, the outer diameter of all the barb rings and the cylindrical rings must also be greater than the greatest inner diameter of the cylindrical hole, whereby all of the rings, barb and cylindrical, are compressed within the hole, thereby to strongly engage the inner wall of the cylindrical hole and fix the manhole step therewithin.

In the case of an inwardly tapered hole, the outer diameter of tip **27*a*' must be sufficiently small that the leg end can seat itself fully within the hole with perhaps some deformation thereof. In this case, the first set of barb rings 29' and 30' are most deflected, the second set of heavier, more massive barb rings 31' are somewhat less deflected and the cylindrical rings 32'** are the least deflected because of the tapering of the hole. Nevertheless, all of the rings, barb and cylindrical, must be engaged and compressed by the inner wall of the hole to have the proper engagement.

If radially spaced reliefs of the rows or sets of wedge teeth created by the beveling previously described were not provided as in FIGS. 1–6, inclusive, as the end of the step is driven into the hole to receive it, an immediate sealing of the hole would be effected when the tip 27*a'* and rings 29', 30' engage the wall hole inner surface. Such is the case in FIGS. 7–9, inclusive and the sealing continues as the barb rings 31 and cylindrical rings 32 are driven on into the hole or opening.

This is not desirable as important goals of the reliefs and grooves of FIGS. 1–6, inclusive include the following:

(1) To release, not build up, any air pressure ahead of the wedge teeth (and drive in step ends) in the dead end tapered holes in the manhole wall;

(2) To provide access for exit of water or liquid materials from the depths of the tapered hole (if such are present) so that (a) the cylindrical end may fully be driven into the tapered hole and (b) hydraulic pressure, shock and resulting damage therefrom not be created, transmitted into or effected in the concrete structure so as to injure the manhole, the tapered hole itself or even penetrate or puncture the manhole wall.

(3) To provide the strongest, least reversible and most difficult pull out possible to obtain by utilizing uniquely shaped and the strongest possible deflectable wall engaging members of discreet tooth form.

Typically, manhole walls may be of almost any thickness, generally running from four to eight inches. The insertion of the tapered ends of these manhole steps thereinto is approximately 3½ inches. The holes cast in the manhole section are typically approximately 3¾inches deep. In "thin" manhole walls, for example 4 to 5 inch thickness, it can be seen easily that hydraulic ram pressure could crack, break out or puncture the manhole walls, which result is very much against specification.

The basic purposes of the relief channels and grooves provided in the length of the outer end portions of the manhole step legs are to, first, relieve air and hydraulic pressure within the holes during drive-in to prevent damage to the manhole wall and, secondly, enable the removal or drive-out of water or other materials which have ben received in the manhole wall cast holes during storage or transport thereof. Should there be a seal of the cavity during drive-in of the step leg ends, and water or other fluid, materials, mud or the like be present therein, the driving in of the tapered end, without proper structural pressure relief provisions, can act exactly like an hydraulic ram and even break out or push through the wall of the manhole. Alternatively, such action may exert unusual pressure on the concrete within the hole, fracturing such or injuring it. The latter would prevent the desired optimum grab of the wedge or barb teeth on the wall. By providing channels and spaces for air pressure and material relief and removal, it is insured that, assuming the manhole receiving openings or passages are formed correctly, the manhole step ends may be fully driven into the holes to get full attachment and engagement thereof.

While manhole or manhole sections may be cast on the job, most are cast in segments and, after cure, transported to the job. The manhole shape, size, etc. is typically specified by the city or engineer for the job in question. With respect to providing the tapered holes in the manhole or manhole segments, the greatest majority are cast as the manhole is formed or poured.

The drive-in or hammer-in manhole steps are not driven into the manhole wall shortly after pouring of the concrete because the concrete needs curing time to set up the desired tensile strength. Driving the steps in early would bruise and deform the concrete. The steps are typically driven in just before or after transport. There may be manhole configurations with offsets and straight, flat portions, as well as the customary arcuate segments.

Typically, drilled holes are utilized only for repairs. A one inch diameter hole is driven or drilled in the wall section. These holes are not tapered, unless a tapered drill is provided (unusual). The subject manhole step leg end constructions give comparable pullout results in straight holes as compared to tapered holes. Thus, the subject constructions are versatile and equally effective in tapered or straight holes.

With respect to the uninterrupted ring form of FIGS. 7–10, inclusive and the interrupted ring construction of FIGS. 1–6, inclusive, the same size relationships with respect to manhole wall hole insertions exist. In a tapered hole, as has been described, the outer diameter of leg end portions 27*a* and 27*b* (27*a'* and 27*b'*) must be sufficiently small that the leg ends may be hammered or driven in to the manhole wall holes a distance that all of the near cylindrical rings 32 (32') are received within the hole. Additionally, the outer diameter of near cylindrical rings 32 (32') must be sufficiently great that said rings are deflected and wedged into the tapered hole. Since the hole is tapered, this means that the outer barb portions of rings 31 will be more deflected and rings 30 and 29 yet further deflected because of the tapered hole.

On the other hand, in a cylindrical hole, it is necessary that the outer diameters 27*a*, 27*b*, 27*c* and 27*d* are all less than the inner diameter of the cylindrical hole, whereby the only engagement with the inside wall of the cylindrical hole will be by the rings 29, 30 31 and 32. In the case of the cylindrical hole, each of the rings noted will be equally deflected on driving in of the leg end its full distance into the cylindrical hole. This is because all of the rings have the same greatest outer diameter, although some deflect more easily than the others. Uniform deflection to a considerable degree is what is desired with respect to a cylindrical hole.

From the foregoing, it will be seen that this invention is one well adapted to attain all of the ends and objects hereinabove set forth together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

I claim:

1. In a manhole step construction comprising a U-shape, strong metal reinforcing bar having molded thereover a configured step and supporting leg U shape fully enclosing said bar to make a composite, yet integral, plastic coated, steel core reinforced manhole step body, said body having an elongate, basically straight step portion at the base thereof with two substantially like and symmetrical leg support members extending substantially parallel to one another and at substantial right angles from the ends of the step portion, the free outer ends of said leg support members being of uniform, cylindrical outer diameter in the entire length thereof and also being adapted to being driven or hammered into paired, spaced apart, formed holes in a wall, the said leg support members end lengths having at least three sections thereto:

(1) an outermost cylindrical end piece, (2) a next outermost length having mounted thereon a plurality of spaced apart, substantially continuous, substantially circular barb members, such barb members being directed toward the outermost cylindrical end piece, and (3) an innermost length having mounted thereon a plurality of spaced apart, substantially continuous, near cylindrical rings, the circular barb members and near cylindrical rings having equal greatest outer diameters in at least substantial portions thereof.

2. A manhole step construction as in claim 1 wherein the near cylindrical rings have the outer faces thereof inclined outwardly.

3. A manhole step construction as in claim 1 wherein the barb members are greater in number than the rings.

4. A manhole step construction as in claim 1 wherein the barb members are of two sizes with the lesser size thereof outboard and the greater size thereof inboard with respect to said step portion.

5. A manhole step construction as in claim 1 wherein the holes in the wall are each inwardly tapered from a greater outer internal diameter to a lesser inner internal diameter.

6. A manhole step construction as in claim 1 wherein the holes in the wall are substantially cylindrical throughout their lengths.

7. A device as in claim 1 wherein all of the barb members and all of the rings are each fully continuous.

8. A device as in claim 1 wherein the said substantially continuous circular barbs and said substantially continuous circular rings each comprise a plurality of rows of axial wedge teeth segments, individual wedge teeth segments being axially separated from one another in each row thereof at four positions, first, on the substantial center lines of the tops and bottoms of said bards and rings in two positions substantially 180° opposed to one another and, secondly, in two positions substantially 90° laterally displaced from said first mentioned separations, at substantial center lines of the opposed sides of said body, the top and bottom axial wedge teeth separations each including an elongate, straight groove separating adjacent ends of wedge teeth segments from one another, said axial wedge teeth segment separations positioned at the top and bottom of the legs additionally including beveled, alternately oppositely extending relieved zones on successively outwardly positioned wedge teeth segment ends on each side of said groove, each beveled zone being adjacent to and opposite a radial wall on the adjacent wedge segment in a given row thereof across said groove, the wedge tooth segment separations at the sides of the outer ends of said manhole step comprising alternate, oppositely extending, beveled reliefs of the said wedge teeth segment ends approaching the side center line, each beveled zone being directly next to a radial wall on the adjacent wedge segment in a given row thereof.

9. A device as in claim 8 wherein said grooves also extend across the top and bottom faces of the outermost cylindrical end pieces.

10. A manhole step leg end adapted to be hammered into a hole in a manhole wall comprising, in combination, an elongate leg end portion of uniform outer diameter of less dimension than the internal diameter of substantially the entire manhole wall hole depth, a plurality of at least substantially continuous, substantially circular barb rings and near cylindrical rings being provided on the periphery of said elongate leg portion along the length thereof, said rings all of equal greatest outer diameter, sets of said rings also being of increasingly greater strength and resistance to deflection and distortion extending outwardly from the free end of the leg portion, the outer diameters of all said rings being greater than the greatest inner diameter of the manhole wall hole.

11. A device as in claim 10 wherein the hole in the manhole wall is tapered inwardly from a greater inside diameter to a lesser inside diameter and the outermost rings on said leg end are of greater outer diameter than the inner diameter of the outermost portion of said manhole wall hole.

12. A device as in claim 10 wherein the barb rings are positioned on said leg end relatively outboard with respect to said manhole wall and more adjacent the free end of the elongate leg portion and the near cylindrical rings are positioned on said leg end relatively inboard away from the free end of the elongate leg portion.

13. A device as in claim 10 wherein the substantially continuous barb rings and substantially continuous near cylindrical rings each comprise a plurality of rows of axial wedge teeth segments, individual wedge teeth segments being axially separated from one another in each row thereof at four positions, first, on the substantial center lines of the tops and bottoms of said barb rings and cylindrical rings in positions substantially 180° opposed to one another and, secondly, in two positions substantially 90° laterally displaced from said first mentioned separations, on substantial center lines of the opposed sides of said body, the top and bottom axial wedge teeth separations each including an elongate, straight groove separating adjacent ends of wedge teeth segments from one another, said axial wedge teeth segment separations positioned at the top and bottom of the legs additionally including beveled, alternately oppositely extending relieved zones on successively inwardly positioned wedge teeth segment ends on each side of said groove, each beveled zone being adjacent to and opposite the radial wall on the adjacent wedge segment in a given row thereof across said groove, the wedge tooth segment separations at the sides of said manhole step comprising alternate, oppositely extending, beveled reliefs of the said wedge teeth segment ends approaching the side center line, each beveled zone being directly next to a radial wall on the adjacent wedge segment in a given row thereof.

14. A device as in claim 10 wherein the barb rings and near cylindrical rings are continuous in their entire lengths around the elongate leg portion.

* * * * *